US006325598B1

(12) United States Patent
Sud et al.

(10) Patent No.: US 6,325,598 B1
(45) Date of Patent: Dec. 4, 2001

(54) VARIABLE CAPACITY SWASH PLATE TYPE COMPRESSOR HAVING PRESSURE RELIEF VALVE

(75) Inventors: Lavlesh Sud; Shane A. Harte, both of Farmington Hills; Yong Huang, Ann Arbor, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/471,649

(22) Filed: Dec. 23, 1999

(51) Int. Cl.[7] ..... F04B 1/26

(52) U.S. Cl. ..... 417/222.2; 417/307; 417/308; 92/72

(58) Field of Search ..... 417/222.2, 222.1, 417/213, 307, 308, 270; 92/72, 71; 91/473

(56) References Cited

U.S. PATENT DOCUMENTS

| | | | | |
|---|---|---|---|---|
| 2,845,876 | * | 8/1958 | Keel | 417/213 |
| 4,138,203 | * | 2/1979 | Slack | 417/269 |
| 4,522,568 | * | 6/1985 | Gelse et al. | 417/307 |
| 4,723,891 | * | 2/1988 | Takenaka et al. | 417/222.2 |
| 4,747,753 | * | 5/1988 | Taguchi | 417/222.2 |
| 4,842,488 | | 6/1989 | Terauchi . | |
| 5,017,096 | * | 5/1991 | Sugiura et al. | 417/222.2 |
| 5,242,274 | * | 9/1993 | Inoue | 417/222.2 |
| 5,567,124 | | 10/1996 | Takenaka et al. . | |
| 5,702,235 | * | 12/1997 | Hirota et al. | 417/222.2 |

FOREIGN PATENT DOCUMENTS

| | | | | |
|---|---|---|---|---|
| 62-298671-A | * | 12/1987 | (JP) | 417/222.2 |
| 1-142277-A | * | 6/1989 | (JP) | 417/222.2 |
| 2-115578-A | * | 4/1990 | (JP) | 417/222.2 |

* cited by examiner

*Primary Examiner*—Cheryl J. Tyler
(74) *Attorney, Agent, or Firm*—Larry I. Shelton

(57) ABSTRACT

A variable capacity swash plate type compressor 10 incorporates a pressure relief valve 43 in fluid communication with a suction chamber 20 and a crank chamber 40. The pressure relief valve 43 prevents over pressurization in the crank chamber 40 to minimize friction and forces acting on the components of the compressor 10.

6 Claims, 2 Drawing Sheets

VARIABLE CAPACITY SWASH PLATE TYPE COMPRESSOR HAVING PRESSURE RELIEF VALVE

FIELD OF THE INVENTION

The present invention relates to a variable capacity swash plate type compressor adapted for use in an air conditioning system for a vehicle, and more particularly to a swash plate type compressor having a valve for controlling the pressure differential between the crank chamber and the suction chamber to facilitate improved pressure regulation in the crank chamber.

BACKGROUND OF THE INVENTION

Variable capacity swash plate type compressors typically include a cylinder block provided with a number of cylinders, a piston disposed in each of the cylinders of the cylinder block, a rotatably supported drive shaft, and a swash plate. The swash plate is adapted to be rotated by the drive shaft. The rotation of the swash plate is effective to reciprocatively drive the pistons. The length of the stroke of the piston is varied by an inclination angle of the swash plate. The inclination angle of the swash plate is varied by controlling the pressure differential between a suction chamber and a crank chamber using a control valve means.

The control of the crank chamber pressure is critical to the performance and durability of the compressor. If the pressure differential between the suction chamber and the crank chamber is too high, certain components in the compressor will be susceptible to failure due to overrates. The pressure differential can also negatively affect the optimum operation of the compressor.

In the prior art, an electronic control valve has been used to control the flow from the crank chamber to the suction plenum. To protect the crank chamber from being over pressurized, the electronic control valve sensed inputs of the crank chamber pressure and suction chamber pressure. Over pressurization can have several undesirable consequences. The components of the compressor are designed to endure forces in a given direction. If the pressure within the crank chamber increases substantially, the forces acting on the various compressor components will reverse causing undesirable effects on the durability of parts such as the pistons and bearings. In addition, the compressor can remain fixed in the minimum capacity condition if the pressure differential is not controlled. Increased friction and decreased durability could also result if the compressor is operated continuously at high crank chamber pressures.

An object of the invention is to produce a swash plate type compressor wherein the pressure in the crank chamber is monitored.

Another object of the invention is to produce a swash plate type compressor wherein the pressure in the crank chamber is controlled to minimize friction and component stresses on the components of the compressor.

Another object of the invention is to produce a swash plate type compressor wherein the pressure in the crank chamber is controlled to result in increased durability and duty cycle of the compressor.

Still another object of the invention is to produce a swash plate type compressor wherein the pressure in the crank chamber is regulated to result in smoother operation of the compressor.

SUMMARY OF THE INVENTION

This invention includes a variable capacity swash plate type compressor. The compressor includes a cylinder block, a cylinder head attached to the cylinder block and cooperating with the cylinder block to form an airtight seal, the head having a suction chamber and a discharge chamber formed therein, a crankcase attached to the cylinder block and cooperating with the cylinder block to define an airtight sealed crank chamber, a pressure control valve in fluid communication with the suction chamber of the head and the crank chamber for adjustably controlling a pressure differential between the suction chamber of the head and the crank chamber, and a pressure relief valve for decreasing a pressure differential between the suction chamber of the head and the crank chamber.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
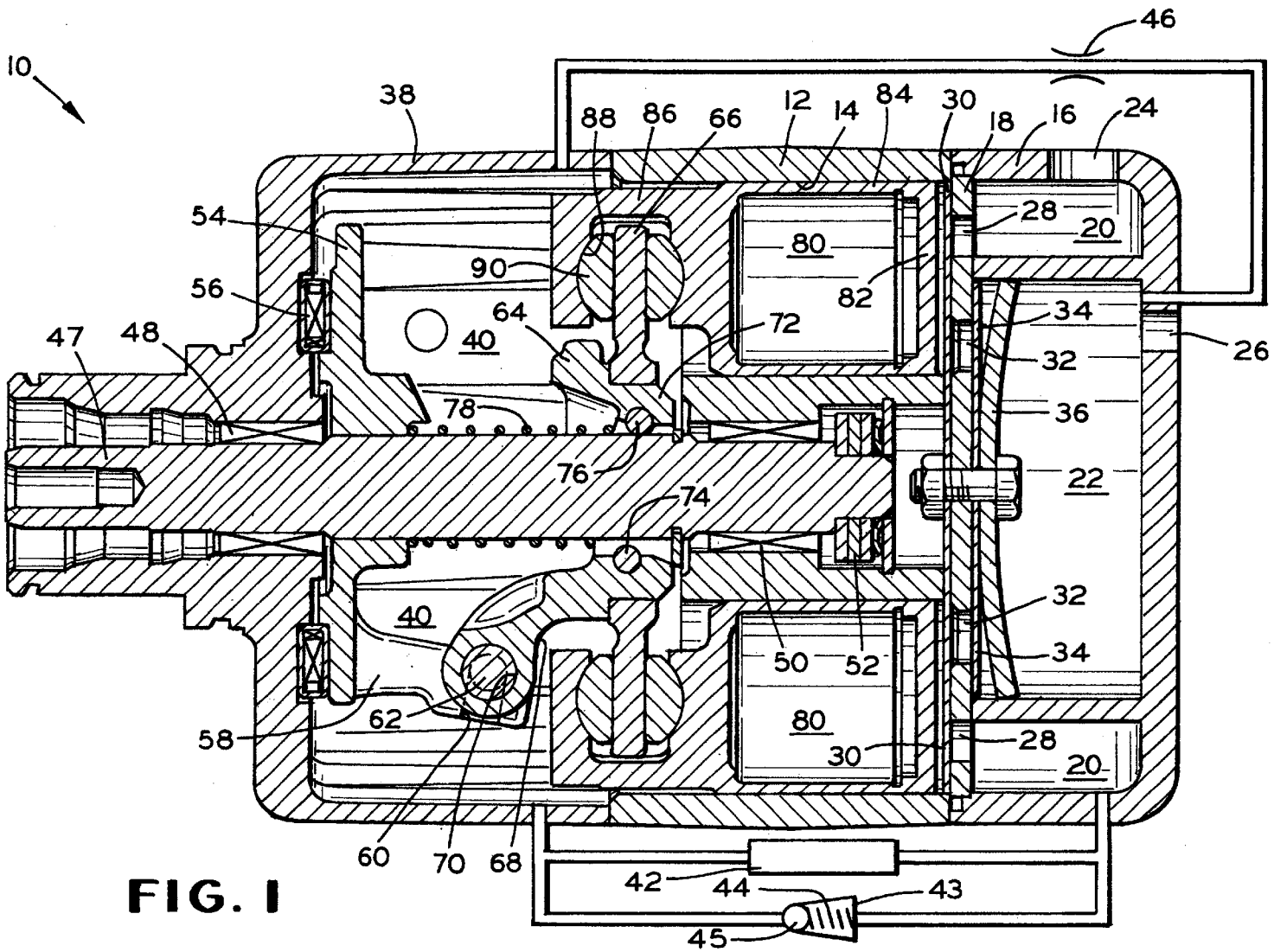
FIG. 1 is a sectional view of a swash plate type compressor incorporating the features of the invention wherein a pressure relief valve is shown for decreasing a pressure differential between the suction chamber the crank chamber and showing the swash plate at a minimum inclination angle.
Figure 2:
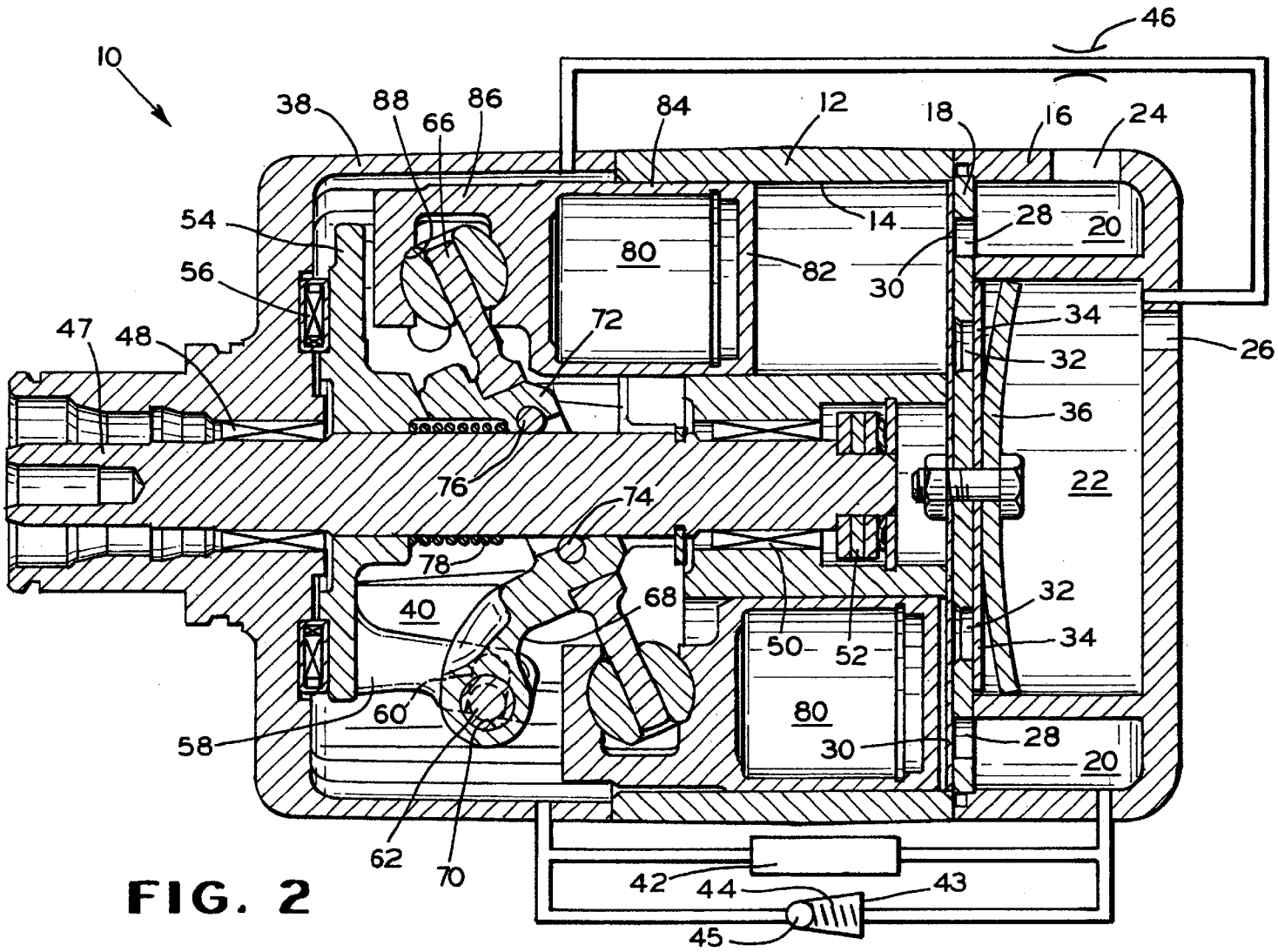
FIG. 2 is a sectional view of the swash plate type compressor illustrated in FIG. 1 showing the swash plate at a maximum inclination angle.

A variable capacity swash plate type compressor according to this invention is indicated generally at 10 in FIGS. 1 and 2. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the head 16.

The head 16 includes a suction chamber 20 and a discharge chamber 22. The suction chamber 20 has an inlet port 24 and the discharge chamber 22 has an outlet port 26. The suction chamber 20 communicates with each of the cylinders 14 through a suction port 28 disposed in the valve plate 18. Each of the suction ports 28 is opened and closed by a suction valve 30. Each of the cylinders 14 communicate with the discharge chamber 22 through a discharge port 32 disposed in the valve plate 18. Each of the discharge ports 32 is opened and closed by a discharge valve 34. The opening of the discharge valve 34 is restricted by a retainer 36.

A crankcase 38 is sealingly disposed at the other end of the cylinder block 12. The crankcase 38 and cylinder block 12 cooperate to form an airtight crank chamber 40. A control valve 42 is provided with the compressor 10 for adjusting a pressure level in the crank chamber 40. A pressure relief valve 43 is disposed between the suction chamber 20 and the crank chamber 40 in a parallel relation to the control valve 42. In the preferred embodiment, the pressure relief valve 43 includes a helical spring 44 and a ball 45. An orifice tube 46 fluidly connects the discharge chamber 22 and the crank chamber 40.

A drive shaft 47 is centrally disposed in and arranged to extend through the crankcase 38 to the cylinder block 12. The drive shaft 47 is rotatably supported by a bearing 48 mounted in the crankcase 38 and a bearing 50 mounted in the cylinder block 12. Longitudinal movement of the drive shaft 47 is restricted by a thrust bearing 52 mounted in the cylinder block 12.

A rotor 54 is fixedly mounted on an outer surface of the drive shaft 47 adjacent one end of the crankcase 38 within the crank chamber 40. A thrust bearing 56 is mounted on an inner wall of the crankcase 38 in the crank chamber 40 disposed between the crankcase 38 and the rotor 54 and provides a bearing surface for the rotor 54. An arm 58 extends laterally from a surface of the rotor 54 opposite the surface of the rotor 54 that contacts the thrust bearing 56. A rectangular slot 60 is formed in the distal end of the arm 58. A pin 62 has one end slidingly disposed in the slot 60 of the arm 58 of the rotor 54.

A swash plate assembly includes a hub 64 and an annular plate 66. The hub 64 includes arm 68 that extends upwardly and laterally from the surface of the hub 64. The distal end of the arm 68 includes a hole 70. The pin 62, with one end slidingly disposed in the slot 60 of the arm 58 of the rotor 54, has the other end fixedly disposed in the hole 70 of the arm 68.

A hollow annular extension 72 depends from the opposite surface of the hub 64 as the arm 68. Two pins 74, 76 are disposed in the hub 64 with a portion of the outer surface of the pins 74, 76 exposed in the aperture of the annular extension 72 of the hub 64.

The annular plate 66 has a centrally disposed aperture. The annular extension 72 of the hub 64 extends through the aperture of the annular plate 66. The drive shaft 47 is inserted in the aperture formed by the hub 64 of the swash plate assembly.

A spring 78 is disposed to extend around the outer surface of the drive shaft 47. One end of the spring 78 abuts the rotor 54. The opposite end of the spring 78 abuts the hub 64 of the swash plate assembly.

A plurality of pistons 80 are slidably disposed in the cylinders 14 in the cylinder block 12. The pistons 80 each include a head 82, a dependent skirt portion 84, and a bridge portion 86. The skirt portion 84 terminates in the bridge portion 86. A pair of concave shoe pockets 88 are formed in the bridge portion 86 of each piston 80 for rotatably supporting a pair of semi-spherical shoes 90. The spherical surfaces of the shoes 90 are disposed in the shoe pockets 88 with a flat bearing surface disposed opposite the spherical face for slidable engagement with opposite surfaces of the annular plate 66 of the swash plate assembly.

The operation of the compressor 10 is accomplished by rotation of the drive shaft 47 by an auxiliary drive means (not shown), which may typically be the internal combustion engine of a vehicle. Rotation of the drive shaft 47 causes the rotor 54 to correspondingly rotate with the drive shaft 47. The swash plate assembly is connected to the rotor 54 by a hinge mechanism formed by the pin 62 slidingly disposed in the slot 60 of the arm 58 of the rotor 54 and fixedly disposed in the hole 70 of the arm 68 of the hub 64. As the rotor 54 rotates, the connection made by the pin 62 between the swash plate assembly and the rotor 54 causes the swash plate assembly to rotate. During rotation, the swash plate assembly is disposed at an inclination angle. The sliding engagement between the annular plate 66 and the shoes 90 causes a reciprocation of the pistons 80 due to the inclination angle of the swash plate assembly. The reciprocation of the pistons 80 causes refrigerant gas to be introduced from the suction chamber 20 of the head 16 into the respective cylinders 14 in which the refrigerant gas is compressed by the reciprocating motion of the pistons 80. The compressed refrigerant gas is discharged from the respective cylinders 14 into the discharge chamber 22.

The capacity of the compressor 10 can be changed by changing the inclination angle of the swash plate assembly and thereby changing the length of the stroke for the pistons 80. The capacity of the compressor 10 is controlled by the control valve 42, which adjustably changes the pressure differential between the crank chamber 40 and the suction chamber 20. Specifically, when the pressure level in the suction chamber 20 is raised with an increase in the thermal load, the control valve 42 cuts off the refrigerant gas travelling between the suction chamber 20 and the crank chamber 40. Therefore, the pressure differential between the crank chamber 40 and the suction chamber 20 is increased and the backpressure acting on the respective pistons 80 in the crank chamber 40 is decreased. As a result, the pin 62 is moved slidably and downwardly within the slot 60, the swash plate assembly is moved against the force of the spring 78, and the inclination angle of the swash plate assembly and the capacity of the compressor are increased, as illustrated in FIG. 2.

Conversely, when the pressure in the suction chamber 20 is lowered with a decrease in thermal load, the control valve 42 permits flow of refrigerant gas between the suction chamber 20 and the crank chamber 40. Therefore, the pressure differential between the crank chamber 40 and the suction chamber 20 is decreased and the backpressure acting on the respective pistons 80 in the crank chamber 40 is increased. As a result, the pin 62 is moved slidably and upwardly within the slot 60, the swash plate assembly yields to the force of the spring 78, and the angle of inclination of the swash plate assembly and the capacity of the compressor are decreased, as illustrated in FIG. 1.

The pressure relief valve 43 operates to relieve an over pressurization in the crank chamber 40. The over pressurization may be caused by malfunction of the control valve 42 or inability of the control valve 42 to accurately control the pressure in the crank chamber 40 at minimum flow conditions. If the pressure differential between the crank chamber 40 and the suction chamber 20 exceeds a set point of the pressure relief valve 43, the ball 45 of the pressure relief valve 43 is urged against the spring 44 and away from the orifice, thereby decreasing the pressure differential by passing refrigerant gas from the crank chamber 40 to the suction chamber 20.

Since the parts of the compressor 10 are designed to endure forces in a given direction and the compressor 10 can be caused to stop in the minimum capacity condition if the pressure differential between the suction chamber 20 and the crank chamber 40 is too great, the pressure relief valve 43 minimizes undesirable wear and potential damage to the compressor 10. The use of the pressure relief valve 43 provides for improved durability of the compressor 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable capacity swash plate type compressor comprising:

a cylinder block having a plurality of cylinders arranged radially and circumferentially therein;

a cylinder head attached to said cylinder block and cooperating with said cylinder black to form an airtight seal, said head having a suction chamber and a discharge chamber formed therein;

a crankcase attached to said cylinder block and cooperating with said cylinder block to define an airtight sealed crank chamber;

a drive shaft rotatably supported by said crankcase and said cylinder block in the crank chamber;

a rotor mounted on said drive shaft in the crank chamber;

a swash plate having a central aperture and opposite surfaces, said drive shaft extending through the aperture of said swash plate;

a hinge means disposed between said rotor and said swash plate to permit said swash plate to be slidable along the outer surface of said drive shaft to thereby change an inclination angle of said swash plate relative to the longitudinal axis of said drive shaft;

a plurality of pistons, each of said pistons reciprocatively disposed in an associated one of the cylinders of said block, each said piston having a pair of shoe pockets;

a rotatable shoe disposed in each of the shoe pockets of each said piston, said shoes being operatively engaged with the opposed surfaces of said swash plate;

a pressure control valve in fluid communication with the suction chamber of said head and the crank chamber for adjustably controlling a pressure differential between the suction chamber of said head and the crank chamber; and a pressure relief valve in fluid communication with the suction chamber of said head and the crank chamber for decreasing a pressure differential between the suction chamber of said head and the crank chamber.

2. The compressor defined in claim 1 wherein said pressure relief valve is fluidly communicated with the suction chamber of said head and the crank chamber in parallel with said pressure control valve.

3. The compressor defined in claim 1 wherein said pressure relief valve is biased to remain normally closed.

4. The compressor defined in claim 3 wherein said pressure relief valve is spring biased.

5. The compressor defined in claim 4 wherein said pressure relief valve is a ball type valve.

6. The compressor defined in claim 1 wherein said pressure relief valve relieves pressure from the crank chamber to the suction chamber of said head.

* * * * *